United States Patent [19]

Ellingson, Jr.

[11] 3,940,886

[45] Mar. 2, 1976

[54] PANIC EXIT DOOR LOCKING STRUCTURE

[75] Inventor: Chester W. Ellingson, Jr., Burnsville, Minn.

[73] Assignee: American Device Manufacturing Company, Steeleville, Ill.

[22] Filed: July 5, 1974

[21] Appl. No.: 485,768

Related U.S. Application Data

[63] Continuation of Ser. No. 321,141, Jan. 5, 1973, abandoned.

[52] U.S. Cl. ..... 49/319; 49/141; 49/368

[51] Int. Cl.[2]. E06B 7/20; E05B 65/10; E05C 15/02

[58] Field of Search ..... 49/319, 141, 308, 366, 49/368, 310, 394, 395; 292/35, 37, 140

[56] References Cited

UNITED STATES PATENTS

| | | | |
|---|---|---|---|
| 928,466 | 7/1909 | Lahart | 49/319 |
| 1,832,592 | 11/1931 | Sweeley et al. | 49/319 |
| 2,015,372 | 9/1935 | Yates | 49/308 |
| 2,083,421 | 6/1937 | Bailey | 49/308 |
| 2,123,107 | 7/1938 | Hodos | 292/37 X |
| 2,610,368 | 9/1952 | Tschaepe | 49/319 |
| 3,660,940 | 5/1972 | Tavano | 49/319 X |

*Primary Examiner*—Philip C. Kannan
*Attorney, Agent, or Firm*—Leo Gregory

[57] ABSTRACT

A door locking structure forming a panic exit device consisting of an elongated housing recessed within the leading edge of a door structure, an operating rod including latch bolts disposed in said housing, an astragal seated within a channel formed in the leading edge of said housing, link members connecting said rod and said astragal and operating means carried by said housing operating said rod to move said astragal inwardly and outwardly of said channel, a plurality of cam headed lug members carried by said rod, a plurality of studs corresponding to said cam members extending rearwardly of said astragal whereby latching movement of said rods moves said cam members to engage their corresponding studs to hold said astragal in an outward or extended dead locked position.

5 Claims, 12 Drawing Figures

FIG. 7
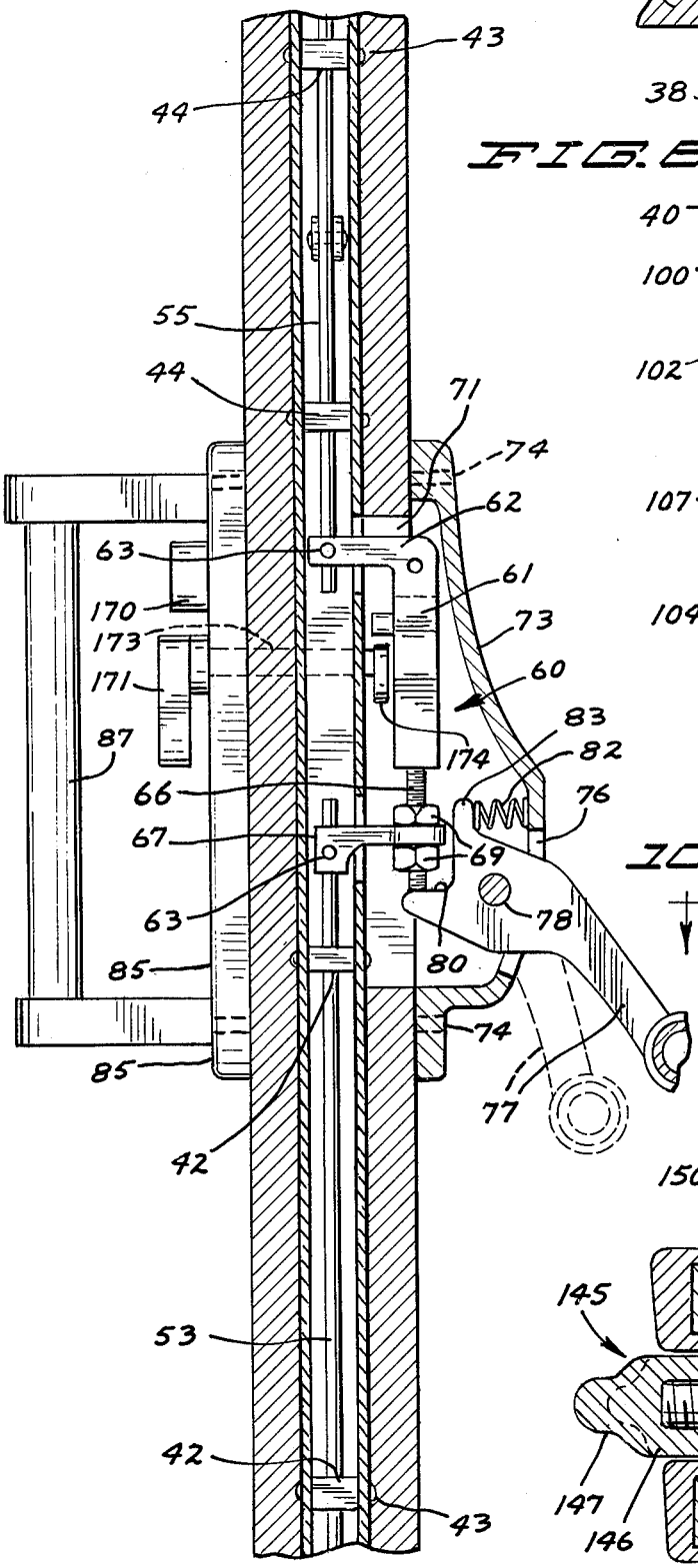
FIG. 8
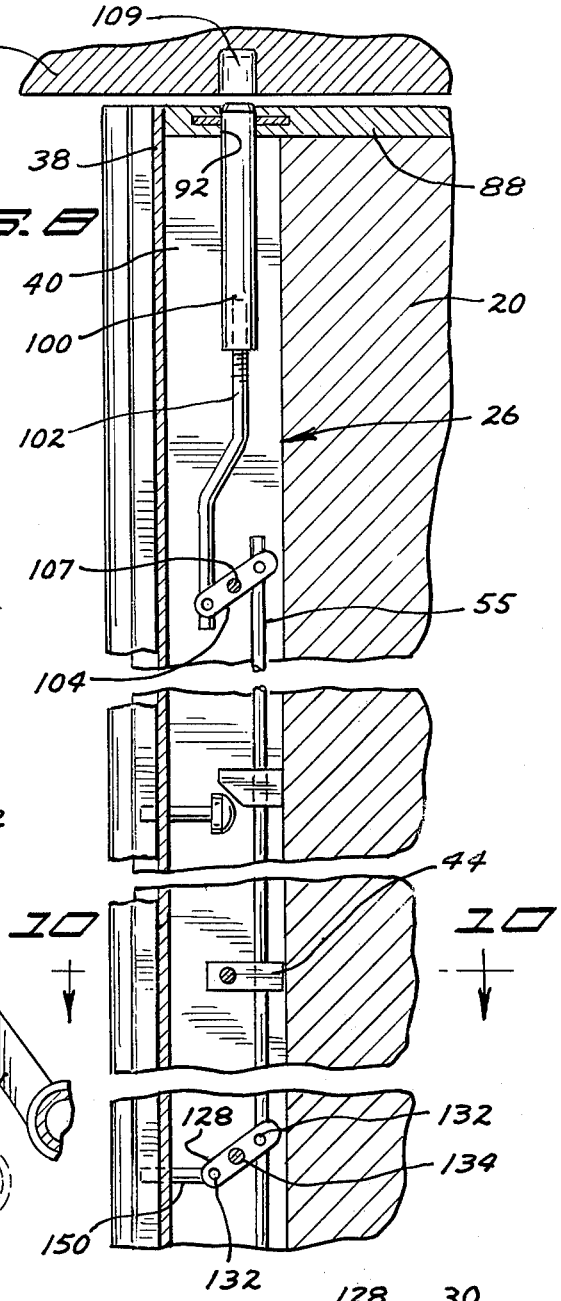
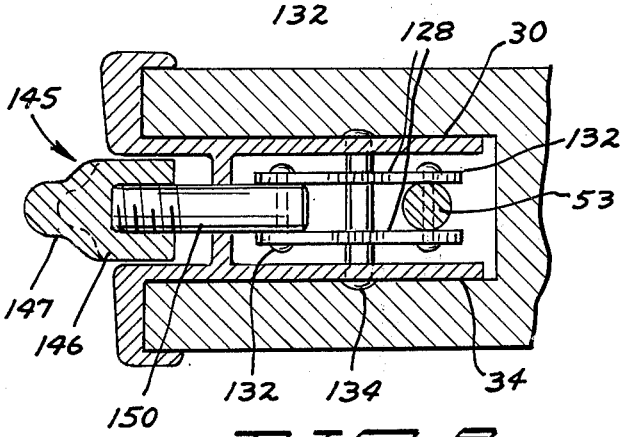
FIG. 9

FIG. 11
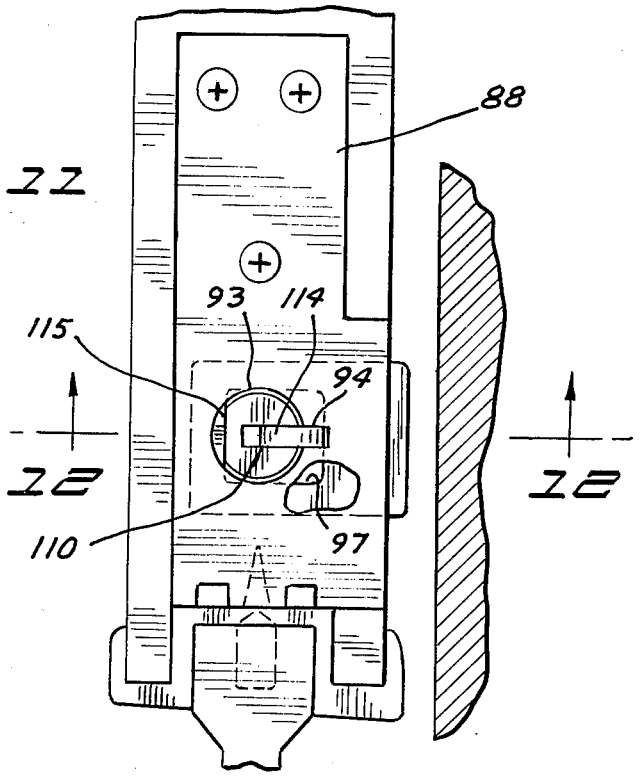
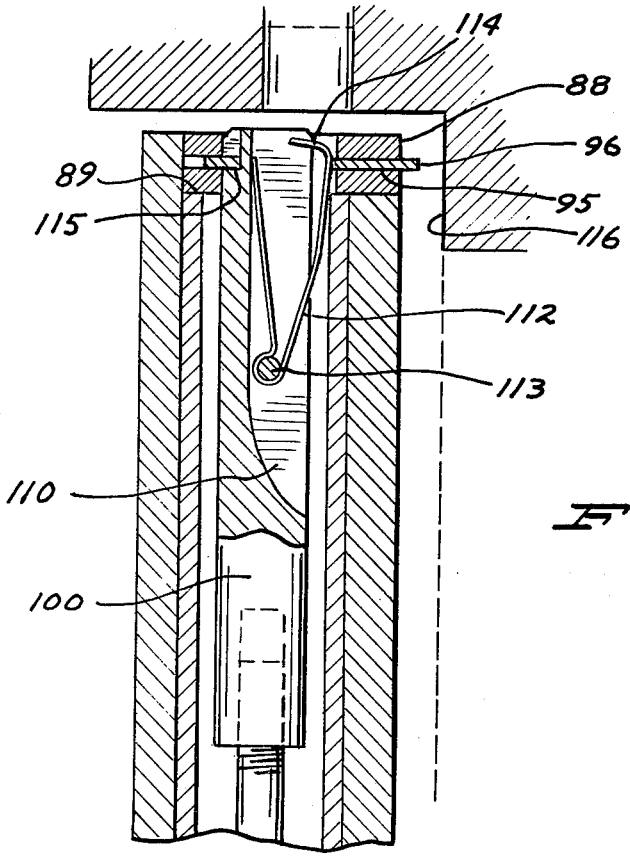
FIG. 12

PANIC EXIT DOOR LOCKING STRUCTURE

This application is a streamlined continuation of U.S. Pat. application Ser. No. 321,141, filed Jan. 5, 1973, now abandoned.

SUMMARY AND BACKGROUND OF THE INVENTION

The invention herein relates to a panic exit device representing an improvement in a door locking structure. Such devices generally consist of an exposed or concealed vertical rod operating top and bottom latch bolts with a hand operated cross bar operating both the vertical rod and door lock whereby exit through the door is readily made with the door locking automatically against entrance therethrough.

The vertical operating rod is in general use. However, in the case of double doors, unless a mullion is used, there is generally an air space between the adjacent door edges or between a door edge and its respective jamb.

The improvement in the invention herein consists primarily in providing an extendable sealing member and means to dead lock said sealing member against retractable movement with respect to a closed door whereby with cooperating sealing members there results both a positive air seal and a barrier preventing an instrument from being disposed between adjacent door edges or between a door and the adjacent jamb to reach the door opening means at the inner side of a door.

It is an object of this invention therefore to provide a panic exit device particularly adapted to form a positive air seal at the leading edge of a door.

It is another object of this invention to provide a panic exit device having an extendable sealing member or astragal forming both a positive air seal and a barrier preventing the insertion of an instrument at the leading edge of a door as between the adjacent edges of a double door or between a door and a jamb which could engage and operate the door opening mechanism at the inner side of a door.

More generally it is an object of this invention to provide a panic exit device consisting of a housing recessed into the leading edge of a door and having vertical operating rod therein, said rod operating upper and lower latch bolts, means operating said rod, an astragal carried in a channel in the leading edge of said housing, links connecting said rod and said astragal for movement of said astragal into and outwardly of said channel, a plurality of cam headed lugs carried by said rod, a plurality of studs corresponding to said lugs carried by said astragal for engagement by said lugs to dead lock said astragal in an extended closed door position.

These and other objects and advantages of the invention will be set forth in the following description made in connection with the accompanying drawings in which like reference characters refer to similar parts throughout the several views and in which:

FIG. 7 is a broken view on an enlarged scale taken on line 7—7 of FIG. 5 as indicated;

FIG. 8 is a broken view in vertical section on an enlarged scale showing a plurality of portions of a device herein;

FIG. 9 is a broken view in horizontal section on an enlarged scale of a detail of structure taken on line 9—9 of FIG. 5 as indicated;

FIG. 11 is a broken top plan view on an enlarged scale of a detail of structure; and FIG. 12 is a broken view in vertical section on an enlarged scale taken on line 12—12 of FIG. 11 as indicated.

DESCRIPTION OF A PREFERRED EMBODIMENT

Figure 1:
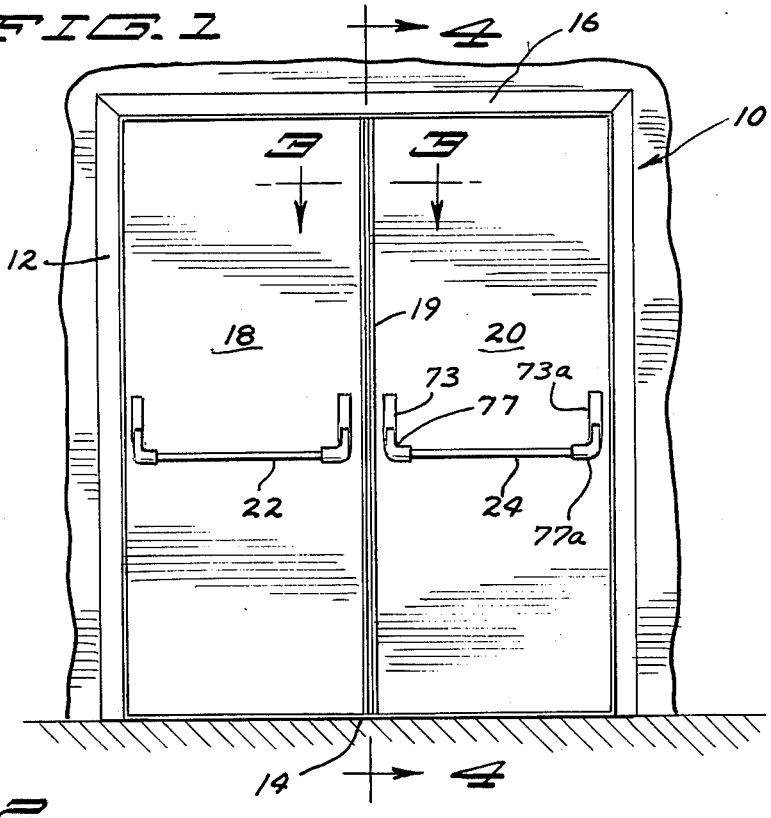
FIG. 1 is a broken view in front elevation on a reduced scale showing a pair of doors having the invention herein installed therein.
Figure 3:
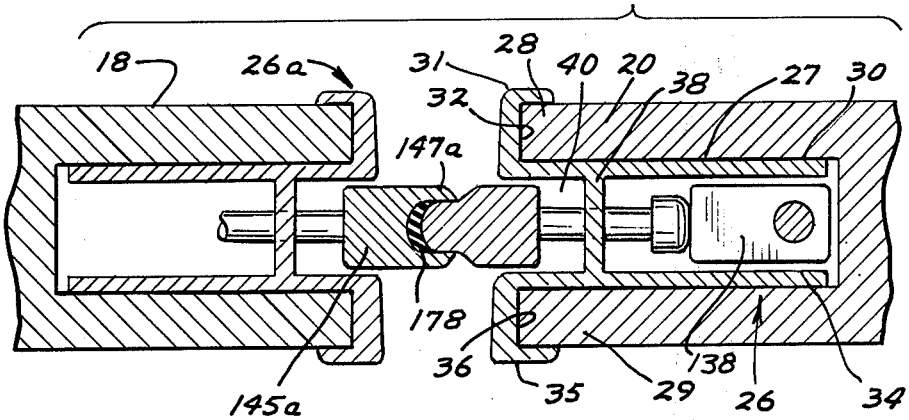
FIG. 3 is a broken view in horizontal section on an enlarged scale taken on line 3—3 of FIG. 1 as indicated.
Figure 10:
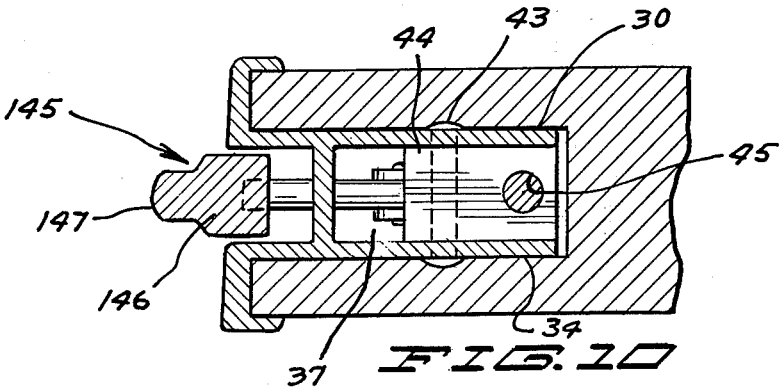
FIG. 10 is a broken view in horizontal section on an enlarged scale of a detail of structure taken on line 10—10 of FIG. 8 as indicated.
Figure 4:
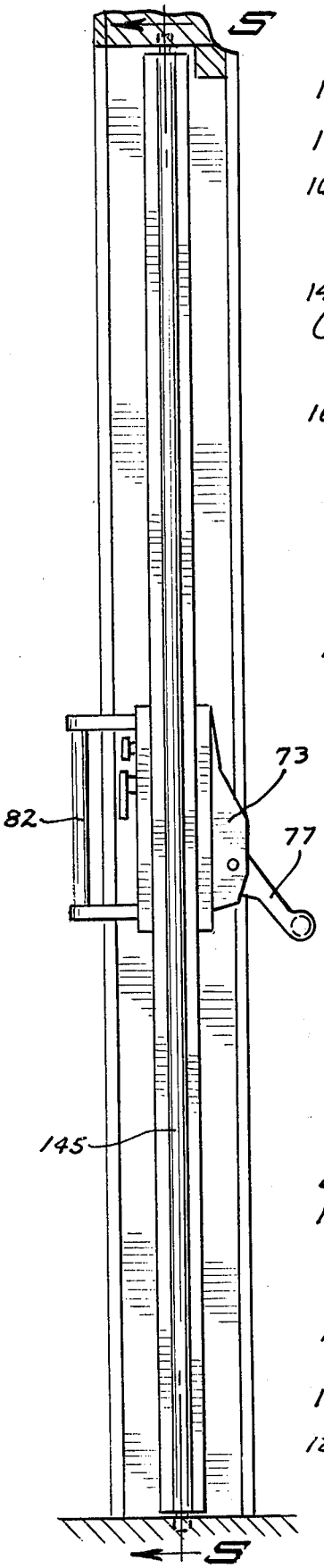
FIG. 4 is a view in vertical section taken on line 4—4 of FIG. 1 as indicated.

With reference to the drawings for purpose of illustration herein, a double door assembly 10 is shown in FIG. 1 which includes a door frame 12 comprising a threshold or sill 14 and an overhead plate or soffit 16, doors 18 and 20 conventionally hinged, said doors having lever arms 22 and 24 to operate the latching mechanism to be described.

Figure 2:
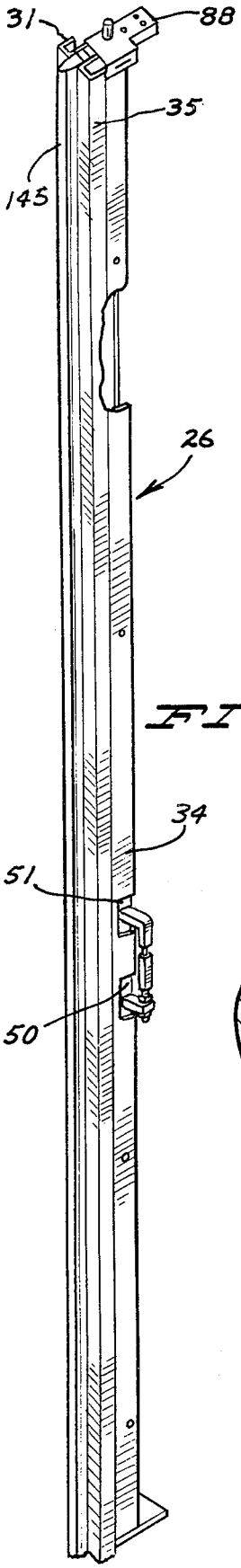
FIG. 2 is a view in perspective showing the device herein.

The latching structure 26 as indicated in FIG. 2, which comprises the subject matter of the invention herein, will be understood to be a distinct item of builders hardware and is herein indicated and described for the most part in an installed or operating position.

Referring generally to the FIGS., the structure 26 is shown disposed into a vertical open-ended channel 27 formed in the leading edge or stile 19 of a door such as door 20.

Said structure 26 which may be conveniently extruded as a unitary member as here illustrated is shown comprising spaced parallel side plate or wall members 30 and 34 respectively having reversely right angled leading edge portions 31 and 35 forming pocket flanges 32 and 36 into which are seated the leading edge portions 28 and 29 of said channel 27. Recessed inwardly of said leading edge portions 31 and 35 and coextensive therewith is a wall 38 which in effect with said leading edge portions 31 and 35 forms forward open ended channel 40 and a rearward channel 37.

Disposed in said channel 37 in vertical spaced relation rearwardly thereof are a plurality of guide block members 42 secured between the lower portion of said side wall members 30 and 34 by bolts 43 and having a plurality of guide block members 44 secured between the upper portion of said side wall members by bolts 43. Said guide block members respectively have apertures 45 and said guide block members are positioned to have their respective apertures in axial alignment.

Figure 5:
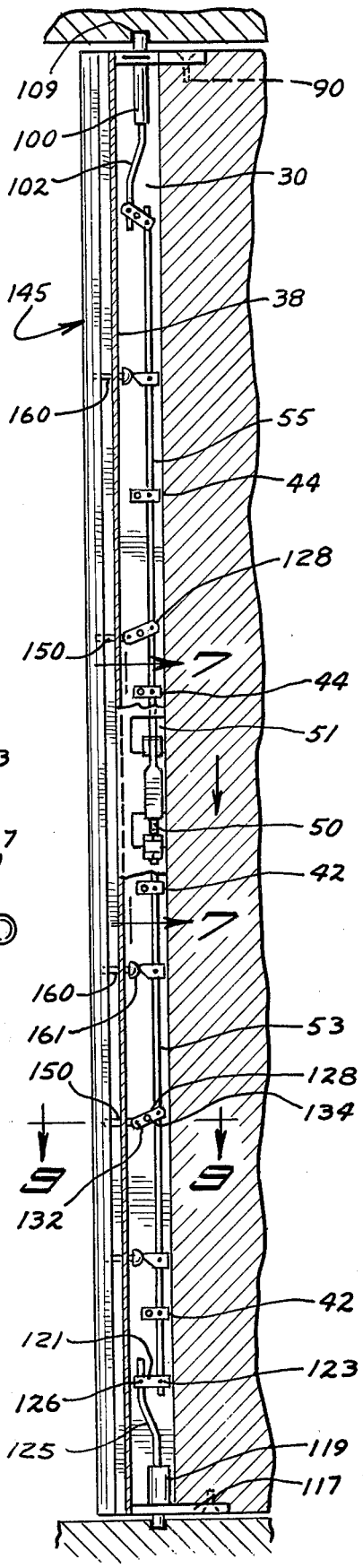
FIG. 5 is a broken view in vertical section taken on line 5—5 of FIG. 4 showing the invention herein in an operating position.
Figure 6:
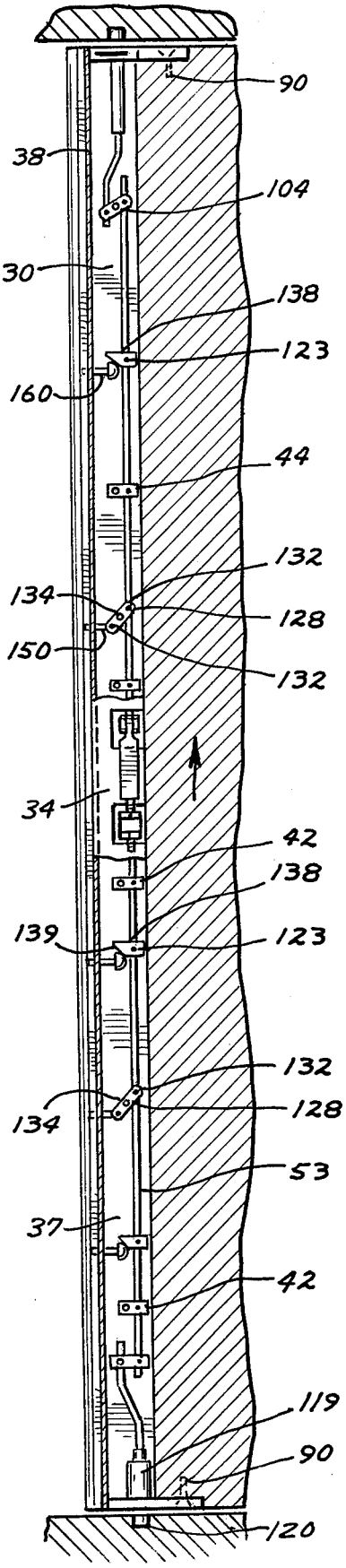
FIG. 6 is a view similar to FIG. 5 showing the device herein in another operating position.

A pair of spaced transverse slots 50 and 51 are formed in the lower rear central portion of said side wall member 34 as indicated in FIGS. 2, 5 and 6.

An operating rod or rod member 53 is disposed through said guide block members 42, said rod extending upwardly to said slot 50. An operating rod 55 is disposed through said guide block members 44 and extends upwardly from said slot 51 as will be further described.

A latch operating member 60 is here illustrated consisting of a bar operating member 61 having an upper angled portion 62 extending transversely through the slot 51 and being apertured to receive therethrough the lower end portion of the rod 55, said rod being secured in said angled portion 62 as by a pin 63. Said bar member 61 has a threaded stud 66 extending therebelow and having an arm 67 slidingly disposed thereon and secured thereon by a pair of nuts 69, said arm being apertured to receive therethrough the upper end portion of said rod 53, said rod end portion being secured therein as by a pin 63.

Said nuts 69 permit axial adjustment between said rod 53 and said member 61. Said slots 50 and 51 will be of sufficient height to accommodate the upward and downward movement of said member 61 in operating the rods 53 and 55 as will be described.

It will be understood that the leading edge portion or stile of the door 20 will be mortised as at 71 to accommodate the member 61 extending therethrough and overlying said mortised opening and said member 61 is a lock casing or housing 73 secured by bolts 74 extending transversely through said door through appropriate accommodating apertures.

Said casing has an opening 76 therein into and through which an operating arm 77 extends being pivoted within said housing by a pin 78. Said arm at its inner end portion has a projecting shoulder 80 engaging the bottom end portion of the threaded stud 66 and said arm is held in a normally inoperative position by a coil spring 82 seated between an upstanding boss portion 83 of the inner end of said arm 77 and the adjacent wall portion of the casing 73 and with said arm 77 in position as illustrated in FIG. 7, the rods 53 and 55 are in normally latching position as will be described.

Said casing 73 is mounted upon the inner side of the door 20. At the outer side of said door 20 is a latch housing or casing 85 through which the bolts 74 are extended to be threaded into an appropriate handle structure 87 of conventional design with said handle structure thus becoming operatively integral with said casing 85.

With reference to FIGS. 6, 8, 11 and 12, at the upper end of said member 26 secured to said wall 38 therein and overlying the upper ends of said wall members 30 and 34 and extending rearwardly thereof is a bolt guide and anchor plate member 88 which fits into an accommodating recess 89 at the forward top edge portion of said door 20 and said member is secured as by screws 90. Said plate member 88 has a vertical circular aperture 93 therein having a radial slot 94 therein. A transverse slot 95 extends through said plate member intersecting said vertical aperture and being adapted to be slidably disposed and contained therein is a plate member 96 having a vertical opening 97 therein having a transverse dimension equal to the diameter of said aperture 93.

Extendable through said aperture 93 is a top latch bolt 100 having an angled rod link 102 threaded into the bottom portion thereof and being pivoted by a link member 104 to the upper end portion of the rod 55 by appropriate pins. Said link member has a pin 107 disposed centrally therethrough and secured in the side wall members 30 and 34 to provide said link member with a lever action whereby an upward movement of said rod 55 retracts said latch bolt 100 and a downward movement of said rod moves said latch bolt upwardly into a latching position.

A soffit strike 109 is recessed into said soffit 16 to be in alignment with said aperture 93 to receive said latch bolt 100.

Said latch bolt 100 has an open ended vertical slot 110 aligned with the slot 94 and has a plate spring 112 therein, said spring being pivoted at its bottom in said slot by a pin 113. Said spring is upwardly outwardly bowed having an upper portion 114 angled inwardly of said slot below the upper end portion of said bolt 100.

Diametrically opposite said slot 110 at the other side of said latch bolt at the upper end portion thereof is a ledge or shoulder 115. Said apertures 93 and 97 are of a size to accommodate the free movement of said latch bolt therethrough. Hence in latching position, said apertures 93 and 97 will be held aligned by said bolt extending therethrough. As the bolt is retracted from apertures 93 and 97, said spring will urge said plate 96 outwardly of said slot 95 with the rear of said plate moving forward to engage the ledge 115 and thus hold said bolt in retracted position. When the door 20 is closed, the plate 96 in extended position will be moved inwardly of the slot 95 by engagement with the conventional stop member of the door frame such as at 116 and the portion of said plate member 96 overlying said ledge 115 will be moved rearwardly thereof thus releasing said latch bolt 100 to move upwardly through the apertures 93 and 97 into latching position into the soffit strike 109.

Referring to FIGS. 5 and 6, recessed in the bottom leading edge portion of the door 20 is plate member 117 secured by screws 90 having a cylindrical latch bolt guide 119 extending upwardly within the channel 37 of said member 26. A threshhold strike 120 is recessed within the threshhold 14 in alignment with said latch bolt guide 119.

Referring to FIGS. 5 and 6, a link 121 receiving the lower end portion of said rod 53 therethrough and being rigid therewith as by a pin or set screw 123 has an angled threshhold latch bolt 125 extending therethrough and being pivoted thereto by a pin 126. Said latch bolt extends into said latch bolt guide 110 for movement therethrough into and out of said threshhold strike 120.

Thus it is seen that an upward movement of the rods 53 and 55 retract the latch bolts 125 and 100 and a downward movement of said rods moves said latch bolts oppositely into latching position.

Referring especially to FIGS. 5, 6, 8 and 9, carried by said rods 53 and 55 respectively are link members 128 each comprising a pair of spaced plate members as shown at either side of said rods in FIG. 9 and being pivoted thereto by pins 132. Said link members respectively have pins 134 extending centrally therethrough and being secured at either end thereof to the walls 30 and 34 as shown. Said pins 134 may be in the form of bolts extending through said wall members and thus said links function as levers.

Also carried by said rods 53 and 55 spaced therealong and secured thereto as by set screws 123 are a plurality of dead locking or cam headed lug members 138 having their cam heads 139 facing toward said wall 38. Said cam heads are formed to be inclined inwardly and downwardly in the direction of said rods 53 and 55 as shown in FIG. 6.

Disposed in said channel 40 and extending outwardly thereof is an elongated sealing member 145 here forming a male astragal having a substantially rectangular body portion 146 within said slot 40 and having a forwardly extending portion 147 of reduced transverse dimension shown here having a rounded leading edge portion. Said astragal within the concept of the invention herein will be formed of a rigid material such as of aluminum and is conveniently formed as by extrusion.

Extending rearwardly of said astragal 145 and secured thereto such as by being threaded thereinto are a pair of vertically spaced stub rods of rod members 150 corresponding in position to said pairs of link members 128. Said link members are pivotly secured to said rods 150 by pins 132.

Also extending rearwardly of said astragal 145 in like manner as said stub rods 150 are studs or stud members 160 corresponding as to position to said cam members 138. Said studs 160 are here shown having dome shaped head portions 161 and are positioned relative to said cam members that when said astragal is in extended position outwardly of the slot 40 that said cam members will ride over said head portions of said rods 160 securing them and said astragal in a dead lock position.

With reference to said casing 73 and operating arm 77, a corresponding casing 73*a* and arm 77*a* will be mounted on door 20 spaced therefrom and said arms 77 and 77*a* will support therebetween the operating bar 24. Door 18 will be equipped in like manner.

With reference to FIG. 7 a conventional cylinder lock 170 is indicated with a cam headed operating handle 171 for unlocking and opening the door 20 from the outer side. These are conventional items with the lock 170 being connected to the operating handle 171 to enable it to either rotate the extended cam head arm 173 and its cam head 174 or to disengage it therefrom. This arrangement is well known in the art. With the cylinder lock 170 in unlocked position, the handle 171 is turned to rotate the cam arm 173 to have its cam head portion 174 thereof operate the arm 61 to raise it upwardly to retract the upper and lower latch bolts for the door to be opened. The operating handle 171 is spring loaded as is conventional to automatically return to an inoperative position whereby there is no interference between the operation of the handle 171 and the otherwise normal operation of the handle member 24 at the inner side of the door.

With reference to FIG. 2, the door 18 is indicated having disposed therein a latching structure 26*a* identical in structure to the latching member 26 above described and including all of the elements described in connection therewith with the only modification thereof being present in the astragal 145*a* which is here shown as a female astragal having an extended concave leading edge portion 147*a* to receive the extended portion 147 of the astragal 146 and disposed therebetween and carried by said portion 147*a* is a resilient sealing member 178. The astragals 145 and 145*a* as here shown are respectively operable to be disengaged from each other for the respective doors 18 and 20 to be opened separately and in engaged position provide a positive weather seal and an effective barrier to prevent the insertion of an instrument therebetween which could be used to open a door from the inner side thereof.

It will be understood that the exit device described herein may be used in a single door installation and in lieu of a female astragal the male astragal will have a like cooperative relationship with a door jamb having a vertical insulated groove therein to receive said astragal.

It is believed that the operation of the invention herein will be well understood from the above description.

It will of course be understood that various changes may be made in form, details, arrangement and proportions of the parts without departing from the scope of the invention herein which, generally stated, consists in an apparatus capable of carrying out the objects above set forth, in the parts and combinations of parts disclosed and defined in the appended claims.

What is claimed is:

1. A door locking structure forming a panic exit device having in combination
   - an elongated housing formed as an open-sided channel,
   - an operating rod disposed longitudinally in said channel,
   - a sealing member in said channel in spaced relation to said rod and movable inwardly and outwardly of said channel,
   - a plurality of vertically spaced links pivoted in said channel intermediate their ends,
   - said links each being pivoted at one end to said rod,
   - said links each being pivoted at their other ends to said sealing member,
   - a door operating means operating said rod to move said sealing member inwardly and outwardly of said channel by means of said links,
   - deadlock means carried by said rod in operative relationship with said sealing member,
   - a latching bolt carried at the upper end of said operating rod,
   - a plate member slidably carried at the upper portion of said channel having an aperture therein,
   - said latch bolt operated by said rod extending through said aperture of said plate member,
   - said latch bolt having a ledge formed in the upper end portion thereof,
   - a spring member normally urging said plate member to overlie said ledge of said latch bolt to retain said latch bolt in retracted position,
   - said plate member having a portion extending outwardly of said channel,
   - a door frame receiving said housing in a door closing position, and
   - said extended portion of said plate member engaging said door frame and yielding to said engagement to release said latch bolt to have the same extend therethrough to latching position.

2. A door locking structure forming a panic exit device having in combination
   - an elongated housing formed as an open-sided channel,
   - an operating rod disposed longitudinally into said channel,
   - a sealing member disposed into said channel in spaced relation to said rod,
   - means connecting said sealing member and said rod for movement of said sealing member to latched position outwardly of said channel by operation of said rod, a plurality of deadlock members carried by said operating rod, said deadlock members each comprising a cam headed member consisting of a projecting portion, and said projecting portion of each of said deadlock members engaging said sealing member in latched position deadlocking the same.

3. The structure set forth in claim 2, wherein said sealing member has stud members extending in the direction of said operating rod, and said stud members respectively being in alignment with said projecting portions of said cam headed members in a deadlock position.

4. The structure set forth in claim 2, wherein said projecting portion of said cam headed member comprises an inclined surface portion and a vertical surface portion.

5. The structure set forth in claim 2, wherein said projecting portions respectively comprise an inclined surface portion and a vertical surface portion, and said stud members are respectively in alignment with said vertical surface portions in a deadlock position.

* * * * *